United States Patent [19]

Ohashi et al.

[11] Patent Number: 4,607,067

[45] Date of Patent: Aug. 19, 1986

[54] FOUNDRY SAND BINDER

[75] Inventors: Keiji Ohashi, Urayasu; Kohichi Handa, Miura, both of Japan

[73] Assignee: Nissan Motor Company, Limited, Yokohama, Japan

[21] Appl. No.: 725,335

[22] Filed: Apr. 19, 1985

[30] Foreign Application Priority Data

Apr. 27, 1984 [JP] Japan ..... 59-83856

[51] Int. Cl.[4] ..... B22C 11/22

[52] U.S. Cl. ..... 623/144; 164/526; 164/527; 524/436

[58] Field of Search ..... 523/144, 145; 164/526, 164/527; 106/38.2; 524/436

[56] References Cited

U.S. PATENT DOCUMENTS

| | | | |
|---|---|---|---|
| 4,283,319 | 8/1981 | Konii et al. | 523/145 |
| 4,371,648 | 2/1983 | Gardikes et al. | 164/526 |
| 4,403,046 | 9/1983 | Anderson et al. | 164/526 |

FOREIGN PATENT DOCUMENTS

| | | |
|---|---|---|
| 55-68153 | 5/1980 | Japan . |
| 59-70438 | 4/1984 | Japan . |

OTHER PUBLICATIONS

Chemical Abstracts, vol. 97, p. 49, Sep. 6, 1982–Sep. 20, 1982.

Chemical Abstracts, vol. 89, p. 30, Aug. 14, 1978–Aug. 28, 1978.

*Primary Examiner*—Lorenzo B. Hayes

*Attorney, Agent, or Firm*—Schwartz, Jeffery, Schwaab, Mack, Blumenthal & Evans

[57] ABSTRACT

A binder is used for binding foundry sand to form a mold and a core for casting, and consists of a condensation-reactive first compound (resin) having at least one methylol group in a molecule, amounting to 100 parts by weight. An additive component is added to the resin to improve the strength and the sand removability of the mold and the core while improving the production yield of the mold and the core. The additive component includes at least one of calcium hydroxide and barium hydroxide in particle form. The particle surface of the at least one of calcium hydroxide and barium hydroxide is coated with a second compound having a melting point not lower than 50° C. and a boiling point ranging from 250° to 400° C., the second compound ranging from 0.5 to 35 parts by weight.

11 Claims, No Drawings

FOUNDRY SAND BINDER

BACKGROUND OF THE INVENTION

1. Field of the Invention

This invention relates in general to casting molds and cores formed by binding foundry sand with a binder, and more particularly to the binder which can render the molds and the cores higher in strength and in sand removability after casting.

2. Description of the Prior Art

In connection with conventional production techniques for molds and cores used in casting, shell molding has been commonly used in which the molds and the cores are formed by binding foundry sand, for example, with a binder of phenolic resin regardless of the kind of alloys to be casted. Particularly, the shell molding has been frequently and effectively used for production of the cores because of superiority in productivity and dimensional accuracy.

However, in case the core produced by the shell molding is used in casting of a light alloy having a relatively low melting point such as aluminum alloy, a part of phenolic resin is subjected to thermal change under the heat of molten metal thereby to form a very rigid carbonized structure, so that the residual strength of the core after casting becomes considerably high. Accordingly, in order to facilitate disintegration of the core, the core is heated together with a resulting casting product at a high temperature such as about 500° C. for a such along time as 5 to 10 hours thereby to burn out the residue of the binder which has the carbonized structure. This necessitates consumption of a large amount of energy. In this regard, it has been eagerly desired to develop binders which are easily thermally decomposable to obtain molds and cores of high disintegration characteristics. To this end, extensive development of a variety of binders offering high disintegration characteristics to molds or cores has been undertaken.

As a part of such development, investigation has been made on thermosetting resins containing no benzene ring in view of the fact that formation of the carbonized structure is due to the benzene ring of phenolic resin. However, such thermosetting resins are not sufficient in heat resistance as compared with phenolic resin and in addition are lower in hot strength. Furthermore, such thermosetting resins are too thermally decomposable, and accordingly gas defects are liable to arise when they are used for producing molds and cores, thereby lowering production yield of the molds and cores.

Moreover, from the view point of reducing the amount of energy required for heating to form the molds and cores, i.e., to solidify the binder, studies have been made to obtain mold and core forming methods in which binders can be solidified at ordinary temperature. As one of these methods, so-called cold box method has been developed in which the combination of phenolic resin composition and isocyanate compound is used as the binder for foundry sand. However, phenolic resin is used also in this method, and therefore the disintegration characteristics of molds or cores after casting is inferior.

SUMMARY OF THE INVENTION

A binder of the present invention is used to bind foundry sand to form casting molds and cores, and consists of as a major part a condensation-reactive first compound (resin) having at least one methylol group in a molecule and amounting to 100 parts by weight. Additionally, an additive component is added to the condensation-reactive first compound to improve the binder in hot and ordinary temperature strengths while improving the disintegration characteristics of the molds or the cores. The additive component includes at least one of calcium hydroxide and barium hydroxide in particle form. The particle surface of the at least one of calcium hydroxide and barium hydroxide is coated with a second compound having a melting point not lower than 50° C. and a boiling point ranging from 250° to 400° C., the second compound ranging from 0.5 to 35 parts by weight.

By virtue of the melting point of the second compound not lower than 50° C., sand packing characteristics during formation or production of the mold or the cores becomes better, thereby improving both the hot and ordinary temperature strengths of the molds and cores. Furthermore, by virtue of the boiling point of the second compound ranging from 250° to 400° C., the resin cannot be affected by the at least one of calcium hydroxide and barium hydroxide during formation or production of the molds and the cores upon heating at 230° to 250° C. in which the particle surface of the at least one of calcium hydroxide and barium hydroxide is securely kept covered with the second compound, thereby maintaining the ordinary temperature strength of the molds and the cores higher while improving production yield of the molds and the cores; whereas the deterioration of the resin can be promoted under the action of the at least one of calcium hydroxide and barium hydroxide during pouring molten metal into the mold at 400° to 500° C. in which the second compound can be effectively vaporized, thereby improving the disintegration characteristics of the molds and the cores while improving the sand removability of the sames after casting.

DETAILED DESCRIPTION OF THE INVENTION

Concerning binders for binding foundry sand to form casting molds and cores, a variety of investigations have been made by the inventors of the present invention upon paying their attention to condensation-reactive compounds or resin used as a major part of the binder. As a result of the investigations, it has been confirmed that a binder formed of the condensation-reactive compound added with calcium hydroxide or barium hydroxide meets the following requirements: (1) Casting molds or cores formed by using the binder exhibit a sufficient strength; and (2) The molds or the cores exhibit high disintegration characteristics in case of casting of relatively low melting point metal such as aluminum alloy.

This will be explained hereinafter exemplifying a case in which a phenolic resin is used as the condensation-reactive compound in combination with calcium hydroxide. In general, the phenolic resin is solidified to have a three dimensional cross linking structure at temperatures of 150° to 200° C., thereby forming a rigid solid resin. Upon further heating, the reaction further progresses in the resin to further raise the strength thereof, the strength reaching its peak value in the vicinity of 300° C. Furthermore heating leads to the thermal deterioration of the resin to lower the strength thereof, the resin becoming the most brittle in the vicinity of 600° C. At temperatures higher than 600° C., the carbonization and graphitization of the resin progress, thereby again raising the strength of the resin.

Calcium hydroxide has a pH value ranging from 12 to 14 and exhibits alkaline characteristics, thereby promoting the hardening and deterioration of the phenol resin when added. Accordingly, by virtue of calcium hydroxide, the hot strength of the casting core during its formation at about 200° C. is improved, whereas the deterioration of the resin occurs during pouring molten aluminum alloy at about 400° to 500° C. in which the resin becomes the most brittle. This seems to improve the disintegration characteristics of the casting mold or the core, improving the removability of foundry sand.

Foundry sand coated with the calcium hydroxide added phenolic resin is usually prepared by supplying the resin into a sand mixer in which sand is stirred, until the temperature of the sand reaches 140° C., and thereafter calcium hydroxide in powder form is continuously added to the content in the mixer. However, in the event that the temperature of the sand is not uniform such that a portion of the sand has a higher temperature, there is a possibility that the resin coated on the higher temperature portion of the sand is gradually hardened to make gelation due to the pH value of calcium hydroxide. When gelation occurs, the adherance of the resin to sand particles becomes insufficient in the case where the casting core is formed by firing the foundry sand. Furthermore, if the firing temperature is higher, the deterioration of the resin is promoted, thereby lowering the strength of the core at ordinary temperature. Accordingly, breaking of the core occurs if it is not handled sufficiently carefully, thereby unavoidingly lowering the production yield of the core. Thus, there arises a problem in which the temperature control of the foundry sand is difficult in the case where the resin is coated on the sand. The above-mentioned fact is the same in the case where barium hydroxide is used in place of calcium hydroxide.

In order to solve the above-discussed problems, the inventors have successfully performed a further study and have found surprisingly that a foundry sand binder having a higher strength at ordinary temperature and good sand removability can be obtained by adding to the condensation-reactive compound calcium hydroxide and/or barium hydroxide whose particle surface is coated with a compound having a melting point not lower than 50° C. and a boiling point ranging from 250° to 400° C.

In view of the above, the foundry sand binder of the present invention is characterized by the fact that calcium hydroxide and/or barium hydroxide whose particle surface is coated with a compound (referred to as a "second compound") having a melting point not lower than 50° C. and a boiling point ranging from 250° to 400° C. is added to a condensation-reactive compound (referred to as a "first compound") having at least one methylol group in a molecule. The first compound tends to undergo a condensation reaction to form a rigid solid resin.

Examples of the above-mentioned condensation-reactive first compound having at least one methylol group in a molecule are phenol-formaldehyde resin, furan resin (furfuryl alcohol-furfural copolycondensation resin, furfuryl alcohol resin, furfural-phenol copolycondensation resin, furfural-ketone copolycondensation resin, furfuryl alcohol-formaldehyde resin, furfuryl alcohol-urea-formaldehyde resin, furfuryl alcohol-phenol-urea-formaldehyde resin, furfuryl alcohol-phenol-formaldehyde resin), melamine-formaldehyde resin, urea-formaldehyde resin, resorcinol-formaldehyde resin, and the like. The above-mentioned compounds are used singly or may be used in combination of two or more.

The phenol-formaldehyde resin is one of phenolic resins and a thermosetting resin obtained by the condensation of phenol and formaldehyde in the presence of acid or alkali. One type of resin obtained by condensation using an acid as a condensing agent is novolak resin, whereas a resin obtained using an alkali as a condensing agent is a resol type resin. The novolak type phenolic resin is difficult to harden even upon heating, and therefore requires a hardener such as hexamethylenetetramine to be hardened. The resol type phenolic resin is hardened merely upon heating. As the condensation-reactive compound of the present invention, a mixture of the novolak type and resol type of phenolic resins is also used in which the hardener such as hexamethylenetetramine is not necessarily required so that the mixture can be hardened upon heating.

Calcium hydroxide is generally called slaked lime and prepared by the reaction between calcium oxide and water, or otherwise by adding alkali hydroxide to an aqueous solution of calcium salt.

Barium hydroxide is prepared by the reaction between barium oxide and water, or otherwise prepared as its octahydrate by the reaction between barium nitrate and a hot aqueous solution of sodium hydroxide, followed by being cooled. Barium hydroxide is readily soluble in water so that its octahydrate has a solubility of 4.181 g/100 g $H_2O$ (at 25° C.).

Calcium hydroxide and barium hydroxide are commercially available in the form of powder or crystal, so that the second compound is coated on the surface of particle of the powder and the crystal.

Examples of the second compound having a melting point not lower than 50° C. and a boiling point ranging from 250° to 400° C. are diphenyl, catechol, p-octylphenol, 3,5-xylenol, bisphenol A, phenylacetic acid, trimethylolpropane, pentachlorophenol, caprylamide, sorbic acid, tribromoacetic acid, n-bis(chloromethyl)-benzene, and the like.

With respect to the melting point of the second compound, if it is lower than 50° C., the second compound will become liquid during storage of resin coated foundry sand in which the temperature becomes 40°-50° C., thus causing the blocking of the resin coated foundry sand. Under such blocking, the foundry sand cannot be well packed or filled particularly when forming the casting core, thereby lowering both the ordinary temperature strength and the hot strength of the core.

With respect to the boiling point of the second compound, if it is lower than 250° C., the coated second compound vaporizes during the formation or production of the core at about 230° to 250° C., so that calcium hydroxide or barium hydroxide inside the coating of the second compound becomes active. This promotes the deterioration of the resin (the first compound), thereby lowering the ordinary temperature strength of the core. If the boiling point of the second compound is higher than 400° C., the coated second compound is difficult to vaporize during molten metal (aluminum alloy) pouring into the mold at about 400° to 500° C., so that calcium hydroxide or barium hydroxide is difficult to become active. This cannot promote the deterioration of the resin (the second compound), thereby degrading the removability of the foundry sand of the core. As will be appreciated from the above, the second compound coated on the particle surface of calcium hydroxide and/or barium hydroxide should have a melting point not lower than 50° C. and a boiling point ranging from 250° C. to 400° C.

It is preferable that not less than 5 parts by weight of the second compound is coated on the particle surface of 100 parts by weight of calcium hydroxide and/or barium hydroxide. In this regard, if less than 5 parts by weight, the coating of the second compound on the particle surface of the calcium hydroxide and/or barium hydroxide is not uniform, so that the particle surface of the same cannot be sufficiently covered, thereby resulting in lowering of the ordinary temperature strength of the core. Furthermore, it is also preferable that not more than 50 parts by weight of the second compound is coated on the particle surface of 100 parts by weight of calcium hydroxide and/or barium hydroxide. In this regard, if more than 50 parts by weight, the second compound cannot sufficiently vaporize during pouring of the molten metal (aluminum alloy) into the mold, so that the activity of calcium hydroxide and/or barium hydroxide cannot be exhibited thereby to lower the sand removability.

The coating of the second compound on the particle surface of the calcium hydroxide and/or barium hydroxide is accomplished, for example, by a so-called wet method in which the second compound is dissolved in a solvent, and thereafter the solution is applied to the surface of particle of calcium hydroxide and/or barium hydroxide to uniformly coat the second compound on the particle surface of the same; or otherwise by a so-called dry method in which the second compound is melted and thereafter directly coated on the particle surface of calcium hydroxide and/or barium hydroxide. It will be understood that any other methods may be used to uniformly coat the second compound onto the particle surface of calcium hydroxide and/or barium hydroxide.

With respect to the added amount of calcium hydroxide and/or barium hydroxide to the condensation-reactive first compound (resin), the sand removability can be improved as the added amount increases. However, a too large added amount prevents the condensation-reactive compound from hardening. In this regard, the added amount of calcium hydroxide and/or barium hydroxide coated with the second compound has been selected to be 0.5 to 35 parts by weight relative to 100 parts by weight of the condensation-reactive first compound, taking account of balance between sand removability and core strength.

In preparing resin coated foundry sand by using the binder of the present invention, the binder is added to and mixed with sufficiently preheated foundry sand in which the binder is coated on the particle surface of the foundry sand upon fusing. At this step, a hardener is added to the condensation-reactive first compound (resin), if desired. In order to produce a mold or a core, the thus prepared resin coated foundry sand is charged or filled into a metal pattern which is preheated at a temperature ranging from 150° to 300° C. which temperature is selected depending on the dimensions and the shape of the mold or the core and on the kinds of the condensation-reactive first compound as a principal component of the binder, and thereafter fired for 10 to 18 seconds thereby to harden the condensation-reactive first compound (resin). Otherwise, the condensation-reactive first compound (resin) may be hardened at ordinary temperature by using organic acid or inorganic acid.

Illustration of the present invention will be now made by way of examples, comparative examples, and experiments.

EXAMPLE 1

Five grams (5 parts by weight) of commercially available trimethylolpropane and 100.0 g of ethanol were charged into a 1000 ml flask thereby to prepare an ethanol solution of trimethylolpropane. Thereafter, 100.0 g (100 parts by weight) of commercially available calcium hydroxide in powder form was added to the ethanol solution. The ethanol was removed by an evaporator with stirring, in which the surface of powder particle of calcium hydroxide was covered with trimethylolpropane. After ethanol removal, the thus treated calcium hydroxide was subjected to vacuum drying to obtain the calcium hydroxide powder whose particle surface was coated with 5 weight % of trimethylolpropane.

Commercially available novolak type phenolic resin (designation "SP-1649" of Gunei Chemical Industry Co., Ltd.) was pulverized into powder, the phenolic resin being phenol-formaldehyde resin. Subsequently, 4.0 kg of silica sand (trade name "Nikko Keisa No. 6" of Kawatetu Mining Co., Ltd.) preheated to 160° C. was charged into a rotating sand mixer, and immediately thereafter a mixture of 80.0 g of the powdered novolak type phenolic resin and 0.4 g (corresponding to 0.5 part by weight to 100 parts by weight of the phenolic resin) of the above-prepared trimethylolpropane coated calcium hydroxide was added and stirred. At the time point the temperature of the silica sand reached 110° C., a 20 weight % concentration aqueous solution of 12.0 g of hexamethylenetetramine was added to the content of the mixer. At the time point the resin had begun to solidify and the sand had entered into its blocking state, 4.0 g of calcium stearate were added into the mixer, in which stirring was continued until the content became into its dried state in appearance, thus preparing a resin coated foundry sand. Then, the temperature of the sand was lowered below the softening point of the resin at the point of stirring termination.

The above-described procedure was repeated seven times with the difference that the added amount of the calcium hydroxide coated with 5 weight % of trimethylolpropane was varied to 2.4 g (3 parts by weight), 4.0 g (5 parts by weight), 8.0 g (10 parts by weight), 12.0 g (15 parts by weight), 16.0 g (20 parts by weight), 24.0 g (30 parts by weight), and 28.0 g (35 parts by weight), respectively. Thus, eight batches of resin coated foundry sand were prepared.

EXAMPLE 2

Commercially available resol type phenolic resin (designation "PS-2176" of Gunei Chemical Industry Co., Ltd.) was pulverized into powder, the phenolic resin being phenol-formaldehyde resin. Subsequently, 6.0 Kg of silica sand (trade name "Nikko Keisa No. 6") preheated to 160° C. were charged into a rotating sand mixer, and immediately thereafter a mixture of 120.0 g of the powdered resol type phenolic resin and 0.6 g (corresponding to 0.5 part by weight to 100 parts by weight of the phenolic resin) of the trimethylolpropane coated calcium hydroxide (as same as in Example 1) was added and stirred. When the resin began to solidify and the sand had entered into its blocking state, 4.0 g of calcium stearate was added into the mixer, thereby preparing a resin coated foundry sand.

The above-described procedure was repeated seven times with the difference that the added amount of the calcium hydroxide coated with 5 weight % of trimethylolpropane was varied to 3.6 g (3 parts by weight), 6.0 g (5 parts by weight), 12.0 g (10 parts by weight), 18.0 g (15 parts by weight), 24.0 g (20 parts by weight), 36.0 g (30 parts by weight), and 42.0 g (35 parts by weight), respectively. Thus, eight batches of resin coated foundry sand were prepared.

EXAMPLE 3

A commercially available mixture (designation "PS-2178" of Gunei Chemical Industry Co., Ltd.) of novolak type phenolic resin (phenol-formaldehyde resin) and resol type phenolic resin (phenol-formaldehyde resin) was pulverized into powder. Subsequently, 6.0 Kg of silica sand (trade name "Nikko Keisa No. 6") preheated to 140° C. was charged into a rotating sand mixer, and immediately thereafter 90.0 g of the phenolic resin mixture and 0.6 g of calcium hydroxide coated with 5 weight % of trimethylolpropane (as same as in Example 1) were charged into the mixer and stirred. When the solidification of the resin mixture had begun and the sand had entered into its blocking state, 4.5 g of calcium stearate were added to the content of the mixer, in which the stirring was continued until the content of the mixer was dry in appearance, thereby preparing a resin coated foundry sand.

The above-described procedure was repeated seven times with the difference that the added amount of the calcium hydroxide coated with 5 weight % of trimethylolpropane was varied to 2.7 g (3 parts by weight), 4.5 g (5 parts by weight), 9.0 g (10 parts by weight), 13.5 g (15 parts by weight), 18.0 g (20 parts by weight), 27.0 g (30 parts by weight), and 31.5 g (35 parts by weight), respectively. Thus, eight batches of resin coated sand were prepared.

EXAMPLE 4

Ten grams of commercially available trimethylolpropane and 100.0 g of ethanol were charged into a 500 ml flask thereby to prepare an ethanol solution of trimethylolpropane. Thereafter, 100.0 g (100 parts by weight) of commercially available calcium hydroxide was added to the ethanol solution. The ethanol was removed by an evaporator with stirring, in which the powder particle surface of the calcium hydroxide was covered with trimethylolpropane. After ethanol removal, the thus treated calcium hydroxide was subjected to vacuum drying to obtain calcium hydroxide powder in which the particle surface was coated with 10 weight % of trimethylolpropane.

A commercially available mixture (designation "PS-2178" Gunei Chemical Industry Co., Ltd.) of novolak type phenolic resin (phenol-formaldehyde resin) and resol type phenolic resin (phenol-formaldehyde resin) was pulverized into powder. Subsequently, 6.0 Kg of silica sand (trade name "Nikko Keisa No. 6") preheated to 140° C. were charged into a rotating sand mixer, and immediately thereafter 90.0 g of the phenolic resin mixture and 9.0 g of the calcium hydroxide coated 10 weight % of trimethylolpropane were charged into the mixer and stirred. At the time point the solidification of the resin mixture had begun and the sand had entered into its blocking state, 4.5 g of calcium stearate were added to the content of the mixer, in which the stirring was continued until the content of the mixer was dry in appearance, thereby preparing a resin coated foundry sand.

The above-described procedure was repeated four times with the difference that the added amount of the calcium hydroxide coated with 10 weight % of trimethylolpropane was varied to 20.0 g (20 parts by weight). 30.0 g (30 parts by weight), 40.0 g (40 parts by weight), and 50.0 g (50 parts by weight), respectively. Thus, five batches of resin coated foundry sand were prepared.

EXAMPLE 5

Ten grams of commercially available diphenyl was charged into a 200 ml flask and stirred upon heating at 75° C. to be melted. Subsequently, 100.0 g of commercially available calcium hydroxide was added to the content in the flask and stirred until uniform coating of diphenyl onto calcium hydroxide in powder form was completed.

After completion of the uniform coating, the content in the flask was cooled to room temperature, thereby obtaining calcium hydroxide coated with 10 weight % of diphenyl.

A single procedure of Example 4 (from pulverization of the mixture of novolak type and resol type phenol resins) was repeated with the difference that 10 parts by weight of the calcium hydroxide coated with 10 parts by weight of diphenyl was charged with the mixture of novolak type and resol type phenolic resins, thereby preparing a single batch of resin coated foundry sand.

EXAMPLE 6

Ten grams of commercially available bisphenol A and 100.0 g of toluene were charged into a 500 ml flask to dissolve bisphenol A in toluene.

One hundred grams of commercially available calcium hydroxide was added to the content in the flask, and then toluene was removed by an evaporator with stirring.

After toluene removal, calcium hydroxide whose particle surface had been covered with bisphenol A was subjected to vacuum drying, thereby obtaining the calcium hydroxide coated with 10 weight % of bisphenol A.

A single procedure of Example 4 (from pulverization of the mixture of novolak type and resol type phenolic resins) was repeated with the difference that 10 parts by weight of the thus obtained calcium hydroxide coated with 10 weight % of bisphenol A was charged with the mixture of novolak type and resol type phenolic resins, thereby preparing a single batch of resin coated foundry sand.

EXAMPLE 7

Ten grams of commercially available catechol and 100.0 g of acetone were charged into a 500 ml flask to dissolve catechol in toluene.

One hundred grams of commercially available calcium hydroxide were added to the content in the flask, and then acetone was removed by an evaporator with stirring.

After acetone removal, the calcium hyydroxide covered with catechol was subjected to vacuum drying, thereby obtaining the calcium hydroxide coated with 10 weight % catechol.

A single procedure of Example 4 (from pulverization of the mixture of novolak type and resol type phenolic resins) was repeated with the difference that 10 parts by weight of the calcium hydroxide coated with 10 weight % of catechol was charged with the mixture of novolak type and resol type phenolic resins, thereby preparing a single batch of resin coated foundry sand.

EXAMPLE 8

Ten grams of commercially available p-octylphenol was charged into a 200 ml flask and stirred upon heating at 90° C. to be melted. One hundred grams of commercially available calcium hydroxide were added into the content in the flask and then stirred until uniform coating of p-octylphenol was completed. After completion of uniform coating, the content in the flask was cooled to the room temperature, thereby obtaining the calcium hydroxide coated with 10 weight % of p-octylphenol.

A single procedure of Example 4 (from pulverization of the mixture of novolak type and resol type phenolic resins) was repeated with the difference that 10 parts by weight of the thus obtained 10 weight % p-octylphenol coated calcium hydroxide was charged with the mixture of novolak type and resol type phenolic resins, thereby preparing a single batch of resin coated foundry sand.

COMPARATIVE EXAMPLE 1

A single procedure of Example 1 was repeated with the difference that the added amount of the trimethylolpropane coated calcium hydroxide was varied to zero (none), and 32.0 g (40 parts by weight), respectively, thereby preparing two batches of resin coated foundry sand.

COMPARATIVE EXAMPLE 2

A single procedure of Example 2 was repeated with the difference that the added amount of the trimethylolpropane coated calcium hydroxide was varied to zero (none), and 48.0 g (40 parts by weight), thereby preparing two batches of resin coated foundry sand.

COMPARATIVE EXAMPLE 3

A single procedure of Example 3 was repeated with the difference that the added amount of the trimethylolpropane coated calcium hydroxide was varied to zero (none), and 36.0 g (40 parts by weight), thereby preparing two batches of resin coated foundry sand.

COMPARATIVE EXAMPLE 4

A single procedure of Example 4 was repeated with the difference that 10 parts by weight of calcium hydroxide without being coated with trimethylolpropane was charged with the mixture of novolak type and resol type phenolic resins, thereby preparing a single batch of resin coated foundry sand.

COMPARATIVE EXAMPLE 5

Ten grams of commercially available zinc stearate was charged into a 200 ml flask and stirred upon heating at 120° C. to be melted. One hundred grams of commercially available calcium hydroxide was added to the content in the flask, and then stirred until uniform coating of zinc stearate onto calcium hydroxide was completed.

After completion of uniform coating, the content in the flask was cooled to the room temperature, thereby obtaining the calcium hydroxide coated with 10 weight % of zinc stearate.

Thereafter, a single procedure of Examle 4 (from pulverization of the mixture of novolak type and resol type phenolic resins) was repeated with the difference that 10 parts by weight of the thus obtained zinc stearate coated calcium hydroxide was charged with the mixture of the novolak type and resol type phenolic resins, thereby preparing a single batch of resin coated foundry sand.

COMPARATIVE EXAMPLE 6

Ten grams of commercially available triphenyl phosphate was charged into a 200 ml flask and stirred upon heating at 50° C. to be melted. Thereafter, Comparative Example 5 was repeated (from addition of calcium hydroxide) with the difference that triphenyl phosphate was used in place of zine stearate, thereby preparing a single batch of resin coated foundry sand.

COMPARATIVE EXAMPLE 7

A single procedure of Example 4 was repeated two times with the difference that the coated amount of trimethylolpropane was varied to 3.0 g (3 parts by weight), and 100.0 g (100 parts by weight), respectively, thereby prepating two batches of resin coated foundry sand.

EXAMPLE 9

Example 1 was repeated with the difference that barium hydroxide was used in place of calcium hydroxide, thereby preparing eight batches of resin coated foundry sand.

COMPARATIVE EXAMPLE 8

A single procedure of Example 9 was repeated two times with the difference that the added amount of the trimethylolpropane coated barium hydroxide was varied to zero (none), and 20.0 g (40 parts by weight), respectively, thereby preparing two batches of resin coated foundry sand.

EXPERIMENT 1

Each batch of resin coated foundry sand prepared in accordance with Examples 1 to 9 and Comparative Examples 1 to 8 was fired at 230° C. and for 70 seconds to obtain a specimen (test piece). A hot tensile strength measurement test was made to each specimen by using a hot shell tensile tester at the above-mentioned firing temperature (230° C.). The result of the hot tensile strength measurment is shown at the column titled "Strength" in Table 1. In Table 1, "Resin" denotes the condensation-reactive first compound (resin); "Coated Compound" the second compound to be coated onto the particle surface of calcium hydroxide or barium hydroxide; "Coating Rate" the coated rate (parts by weight) of the second compound relative to calcium hydroxide or barium hydroxide; and "Addition Rate" the rate (parts by weight) of calcium hydroxide or barium hydroxide coated with the second compound relative to the condensation-reactive first compound (resin).

EXPERIMENT 2

Each batch of resin coated foundry sand prepared in accordance with Examples 1 to 9 and Comparative Examples 1 to 8 was fired at 230° C. and for 70 seconds to obtain a specimen (test piece). After the specimen was cooled to room temperature, a tensile strength measurement test was made to each specimen at room temperature by using a shell tensile tester. The result of the tensile strength measurement at ordinary temperature is shown at the column of "Ordinary Temp. Strength".

EXPERIMENT 3

Each of the batches of resin coated foundry sand prepared in accordance with Examples 1 to 9 and Comparative Examples 1 to 8 was poured into a metal pattern heated to 200° C. or higher and maintained at 250° C. for 5 minutes as it was in the metal pattern thereby to produce a specimen (test piece) having the dimensions of 50 mm length, 50 mm width and 20 mm thickness. The specimen was wrapped in an aluminum foil having the dimensions of 170 mm length and 125 mm width, and put in a furnace to be heated at 500° C. After lapse of 21.5 minutes, the specimen was taken out from the furnace to be cooled. The heating condition of this heat treatment in the furnace corresponds to that in which the worst disintegration characteristics of molds and cores is encountered usually in case the molds and cores are actually prepared from resin coated foundry sand.

Sand drop amount measurement test was made to the specimen subjected to the heat treatment, by using a Ro-Tap type sieving apparatus which is usually used to particle size measurement test according to JIS (Japanese Industrial Standard) Z2602 and is equipped with only a 4-mesh seive. More specifically, the specimen was put on the sieve under which a receiving container was placed, and then the sieving operation of the sieving apparatus was made for 1 minute to vibrate the sieve, so that sand grains produced due to the disintegration of the specimen were dropped to the receiving container passing through the sieve. The amount of the sand grains dropped to the receiving container was recorded as a sand drop amount. As a result, the disintegration rate of the specimen was represented as an weight percent of the sand drop amount to the weight of the specimen before being subjected to vibration. The thus obtained disintegration rate is shown at the column of "Disintegration rate" in Table 1.

TABLE 1

| | Resin | Coated Compound | Coating Rate (parts by weight) | Addition Rate (parts by weight) | Hot Strength ($kg/cm^2$) | Ordinary Temp. Strength ($kg/cm^2$) | Disintegration Rate (weight %) |
|---|---|---|---|---|---|---|---|
| Example 1 | Novolak type phenolic resin (SP-1640) | Trimethylol-propane | 5 | 0.5 | 13.0 | 24.5 | 55 |
| | | | | 3 | 12.8 | 24.2 | 60 |
| | | | | 5 | 12.8 | 23.5 | 65 |
| | | | | 10 | 12.5 | 23.4 | 70 |
| | | | | 15 | 11.5 | 20.0 | 88 |
| | | | | 20 | 11.4 | 20.0 | 96 |
| | | | | 30 | 11.4 | 18.5 | 99 |
| | | | | 35 | 10.8 | 17.4 | 100 |
| Example 2 | Resol type phenolic resin (PS-2176) | Trimethylol-propane | 5 | 0.5 | 10.8 | 19.5 | 76 |
| | | | | 3 | 10.3 | 18.7 | 80 |
| | | | | 5 | 10.0 | 18.5 | 86 |
| | | | | 10 | 9.5 | 18.0 | 89 |
| | | | | 15 | 9.8 | 17.1 | 99 |
| | | | | 20 | 8.0 | 16.5 | 100 |
| | | | | 30 | 7.3 | 16.3 | 100 |
| | | | | 35 | 7.0 | 15.3 | 100 |
| Example 3 | Novolak type phenolic resin (60) + Resol type phenolic resin (40) (PS-2178) | Trimethylol-propane | 5 | 0.5 | 10.2 | 19.8 | 66 |
| | | | | 3 | 10.3 | 18.9 | 70 |
| | | | | 5 | 9.9 | 18.8 | 75 |
| | | | | 10 | 9.2 | 18.1 | 81 |
| | | | | 15 | 8.8 | 17.3 | 89 |
| | | | | 20 | 7.4 | 16.9 | 97 |
| | | | | 30 | 6.1 | 15.9 | 100 |
| | | | | 35 | 5.9 | 15.8 | 100 |
| Comparative Example 1 | SP-1640 | Trimethylol-propane | 5 | 0 | 13.0 | 26.0 | 30 |
| | | | | 40 | 8.1 | 13.1 | 100 |
| Comparative Example 2 | PS-2176 | Trimethylol-propane | 5 | 0 | 10.3 | 23.0 | 69 |
| | | | | 40 | 5.0 | 11.1 | 100 |
| Comparative Example 3 | PS-2178 | Trimethylol-propane | 5 | 0 | 10.0 | 22.9 | 59 |
| | | | | 40 | 4.3 | 10.3 | 100 |
| Example 4 | Novolak type Phenolic resin (60) + Resol type Phenolic resin (40) (PS-2178) | Trimethylol-propane | 10 | 10 | 12.0 | 17.1 | 80 |
| | | | 20 | | 11.5 | 17.5 | 81 |
| | | | 30 | | 11.8 | 18.0 | 81 |
| | | | 40 | | 11.3 | 18.7 | 75 |
| | | | 50 | | 11.0 | 19.0 | 70 |
| Example 5 | Novolak type Phenolic resin (60) + Resol type Phenolic resin (40) (PS-2178) | Diphenyl | 10 | 10 | 11.5 | 15.0 | 81 |
| Example 6 | Novolak type | Bisphenol A | 10 | 10 | 11.1 | 15.2 | 78 |

TABLE 1-continued

| | Resin | Coated Compound | Coating Rate (parts by weight) | Addition Rate (parts by weight) | Hot Strength ($kg/cm^2$) | Ordinary Temp. Strength ($kg/cm^2$) | Disintegration Rate (weight %) |
|---|---|---|---|---|---|---|---|
| | Phenolic resin (60) + Resol type Phenolic resin (40) (PS-2178) | | | | | | |
| Example 7 | Novolak type Phenolic resin (60) + Resol type Phenolic resin (40) (PS-2178) | Catechol | 10 | 10 | 12.0 | 16.1 | 79 |
| Example 8 | Novolak type Phenolic resin (60) + Resol type Phenolic resin (40) (PS-2178) | p-Octylphenol | 10 | 10 | 12.8 | 16.9 | 75 |
| Comparative Example 4 | Novolak type Phenolic resin (60) + Resol type Phenolic resin (40) (PS-2178) | — | 0 | 10 | 9.2 | 11.2 | 81 |
| Comparative Example 5 | Novolak type Phenolic resin (60) + Resol type Phenolic resin (40) (PS-2178) | Zinc Stearate | 10 | 10 | 12.0 | 18.0 | 52 |
| Comparative Example 6 | Novolak type Phenolic resin (60) + Resol type Phenolic resin (40) (PS-2178) | Triphenyl Phosphate | 10 | 10 | 10.0 (blocking) | 12.0 (degraded sand packing) | 82 |
| Comparative Example 7 | Novolak type Phenolic resin (60) + Resol type Phenolic resin (40) (PS-2178) | Trimethylol-propane | 3<br>100 | 10 | 12.1<br>11.1 | 16.0<br>20.1 | 83<br>55 |
| Example 9 | Novolak type phenolic resin (SP-1640) | Trimethylol-propane | 5 | 0.5<br>3<br>5<br>10<br>15<br>20<br>30<br>35 | 13.1<br>12.9<br>12.8<br>12.3<br>11.4<br>11.2<br>11.0<br>10.5 | 24.9<br>24.5<br>23.3<br>23.4<br>20.1<br>20.2<br>18.9<br>17.9 | 50<br>55<br>60<br>64<br>83<br>88<br>89<br>95 |
| Comparative | SP-1640 | Trimethylol- | 5 | 0 | 13.0 | 26.0 | 30 |

TABLE 1-continued

| Resin | Coated Compound | Coating Rate (parts by weight) | Addition Rate (parts by weight) | Hot Strength (kg/cm$^2$) | Ordinary Temp. Strength (kg/cm$^2$) | Disintegration Rate (weight %) |
|---|---|---|---|---|---|---|
| Example 8 | propane | | 40 | 8.0 | 12.1 | 100 |

What is claimed is:

1. A binder composition for foundry sand, comprising:

a condensation-reactive first compound having at least one methylol group in a molecule and amounting to 100 parts by weight; and a component including at least one of calcium hydroxide and barium hydroxide in particle form, and a second compound having a melting point not lower than 50° C. and a boiling point ranging from 250° to 400° C., said second compound being coated on a particle surface of said at least one of calcium hydroxide and barium hydroxide, said component ranging from 0.5 to 35 parts by weight.

2. A binder composition as claimed in claim 1, wherein said second compound amounts to not less than 5 parts by weight relative to 100 parts by weight of said at least one of calcium hydroxide and barium hydroxide.

3. A binder composition as claimed in claim 2, wherein said second compound amounts to not more than 50 parts by weight relative to 100 parts by weight of said at least one of calcium hydroxide and barium hydroxide.

4. A binder composition as claimed in claim 1, wherein said second compound is at least one selected from the group consisting of diphenyl, catechol, p-octylphenol, 3,5-xylenol, bisphenol A, phenylacetic acid, trimethylolpropane, pentachlorophenol, caprylamide, sorbic acid, tribromoacetic acid, and n-bis(-chloromethyl)benzene.

5. A binder composition as claimed in claim 1, wherein said condensation-reactive first compound is at least one selected from the group consisting of phenol-formaldehyde resin, furfuryl alcohol-furfural copolycondensation resin, furfuryl alcohol resin, furfural-phenol copolycondensation resin, furfural-ketone copolycondensation resin, furfuryl alcohol-formaldehyde resin, furfuryl-alcohol-urea-formaldehyde resin, furfuryl alcohol-phenol-urea-formaldehyde resin, furfuryl alcohol-phenol-formaldehyde resin, melamine-formaldehyde resin, urea-formaldehyde resin, and resorcinol-formaldehyde resin.

6. A molding composition for forming a mold and a core for casting, said molding composition comprising foundry sand, a binder for binding said foundry sand, said binder including a condensation-reactive first compound having at least one methylol group in a molecule, and a component including at least one of calcium hydroxide and barium hydroxide in particle form, and a second compound having a melting point not lower than 50° C. and a boiling point ranging from 250° to 400° C., said second compound being coated on a particle surface of said at least one of calcium hydroxide and barium hydroxide, said second compound amounting to 0.5 to 35 parts by weight relative to 100 parts by weight of said condensation-reactive first compound.

7. A method for preparing a binder for foundry sand, said binder including as a major part a condensation-reactive first compound having a methylol group in a molecule, said method comprising:

coating a surface of at least one of calcium hydroxide and barium hydroxide in particle form with a second compound having a melting point not lower than 50° C. and a boiling point ranging from 250° to 400° C. to form an additive component; and mixing said additive component with said condensation-reactive first compound, said additive component ranging from 0.5 to 35 parts by weight relative to 100 parts by weight of said condensation-reactive first compound.

8. A method as claimed in claim 7, wherein said second compound amounts to not less than 5 parts by weight relative to 100 parts by weight of said at least one of calcium hydroxide and barium hydroxide.

9. A method as claimed in claim 8, wherein said second compound amounts to not more than 50 parts by weight relative to 100 parts by weight of said at least one of calcium hydroxide and barium hydroxide.

10. A method as claimed in claim 7, wherein said second compound is at least one selected from the group consisting of diphenyl, catechol, p-octylphenol, 3,5-xylenol, bisphenol A, phenylacetic acid, trimethylolpropane, pentachlorophenol, caprylamide, sorbic acid, tribromoacetic acid, and n-bis(chloromethyl)benzene.

11. A method as claimed in claim 7, wherein said condensation-reactive first compound is at least one selected from the group consisting of phenol-formaldehyde resin, furfuryl alcohol-furfural copolycondensation resin, furfuryl alcohol resin, furfural-phenol alcohol copolycondensation resin, furfural-ketone copolycondensation resin, furfuryl alcohol-formaldehyde resin, furfuryl alcohol-urea-formaldehyde resin, furfuryl alcohol-phenol-urea-formaldehyde resin, furfuryl alcohol-phenol-formaldehyde resin, melamine-formaldehyde resin, urea-formaldehyde resin, and resorcinol-formaldehyde resin.

* * * * *